US005734960A

United States Patent [19]

Patrician et al.

[11] Patent Number: 5,734,960

[45] Date of Patent: Mar. 31, 1998

[54] PROCESS FOR PRODUCING KS MOLYBDENUM

[75] Inventors: Thomas J. Patrician, Monroeton; Michael J. Miller, Towanda; James N. Christini, Towanda; Michael J. Cheresnowsky, Towanda; Vernon L. Carr, Jr., Rome, all of Pa.

[73] Assignee: Osram Sylvania Inc., Danvers, Mass.

[21] Appl. No.: 297,476

[22] Filed: Aug. 29, 1994

[51] Int. Cl.[6] ..... B22F 1/00; B22F 3/12; B22F 9/22

[52] U.S. Cl. ..... 419/28; 419/33; 419/38; 75/369; 75/623

[58] Field of Search ..... 75/369, 623; 419/28, 419/33, 38

[56] References Cited

U.S. PATENT DOCUMENTS

| | | | |
|---|---|---|---|
| 4,045,216 | 8/1977 | Meyer et al. | 75/84 |
| 4,491,560 | 1/1985 | Fujii et al. | 420/429 |
| 4,599,224 | 7/1986 | Vanderpool et al. | 423/606 |
| 4,605,538 | 8/1986 | Vanderpool | 423/55 |
| 4,612,172 | 9/1986 | Brunelli et al. | 423/56 |
| 4,622,068 | 11/1986 | Rowe et al. | 75/245 |
| 4,643,884 | 2/1987 | Cheresnowsky et al. | 423/53 |
| 4,859,236 | 8/1989 | Patrician et al. | 75/0.5 AB |
| 5,059,573 | 10/1991 | Sasaki et al. | 502/205 |

*Primary Examiner*—Daniel J. Jenkins
*Attorney, Agent, or Firm*—Robert F. Clark

[57] ABSTRACT

A process for producing potassium and silicon doped molybdenum (KS molybdenum). The process involves mixing an aqueous ammonium molybdate solution and a dilute aqueous potassium silicate solution. The molybdate solution has a pH and a specific gravity sufficient to promote formation of diammonium molybdate crystals in the mixture. Preferably, the pH is about 8.8–11.0 and the specific gravity is about 1.20–1.32. The amount of potassium silicate and the amount of potassium silicate solution are selected to provide predetermined amounts of potassium and silicon in the mixture, preferably about 800–1300 ppm potassium and about 500–1100 ppm silicon, both amounts based on the amount of molybdenum. The mixture is heated to aid dissolution of the potassium silicate and ammonium molybdate in said mixture and to produce a homogeneous solution of ammonium molybdate, potassium, and silicon. The ammonium dimolybdate doped with potassium and silicon is then crystallized out of solution and calcined, for example in an atmosphere of dissociated ammonia, to produce molybdenum dioxide doped with potassium and silicon. The doped molybdenum dioxide is reduced, for example in a flowing hydrogen atmosphere, to produce a doped molybdenum powder, which then may be pressed and sintered to full density.

15 Claims, No Drawings

PROCESS FOR PRODUCING KS MOLYBDENUM

BACKGROUND OF THE INVENTION

The present invention relates to potassium and silicon doped molybdenum metal, known in the art as "KS molybdenum". The invention relates particularly to a process for doping molybdenum with potassium and silicon to produce KS molybdenum.

Pure molybdenum is brittle, and exhibits an equiaxed grain structure in the recrystallized material. KS molybdenum, an alloy of molybdenum with potassium and silicon, has a higher recrystallization temperature than pure molybdenum and, in its recrystallized state, has interlocking elongated grains which exhibit high ductility. The potassium level is typically 50–400 ppm in the sintered alloy; the silicon level typically is 50–500 ppm. Some manufacturers have added aluminum to the KS molybdenum at a typical level of 20–100 ppm. The aluminum, however, is not necessary to achieve the high recrystallization temperature and ductility after recrystallization as described above. It is rather the combination of chemistry of the alloy and moderately high levels of working of the alloy (true strain greater than 3) that produces these properties.

Prior to the present invention, doping was achieved during powder metallurgical processing. The potassium and silicon containing component(s) are added to molybdenum dioxide or molybdenum trioxide. For example, in one process the powdered molybdenum oxide is sprayed with a potassium silicate solution to dampen it, then the mixture is dried to trap the dopants either chemically or physically on the surface of the oxide powder. In another process, a suspension is prepared in which the molybdenum oxide is thoroughly wet by an appropriate liquid. The dopant components are thoroughly stirred into the suspension, and the suspension is dried to trap the dopants on the oxide. In either of these methods, the doped, dried oxide is milled to break up agglomerates. If the oxide is molybdenum trioxide, it must then be reduced in an atmosphere of dissociated ammonia or hydrogen to produce the dioxide. In either process, the molybdenum dioxide is reduced to molybdenum powder in a hydrogen atmosphere. Both reduction processes are performed under similar conditions to those used commercially for producing a pure molybdenum metal powder. These doping processes are expensive to perform on a commercial scale and are labor intensive.

It would be desirable, to have a process for producing KS molybdenum at about the same cost as that to produce pure molybdenum metal. The process described herein was developed to address that need.

SUMMARY OF THE INVENTION

Accordingly, it is an object of this invention to provide an economical process for producing potassium and silicon doped molybdenum.

It is another object of this invention to provide a process for producing potassium and silicon doped molybdenum at about the same cost as that to produce pure molybdenum metal.

In one aspect, the invention is a process for producing potassium and silicon doped molybdenum (KS molybdenum). The process includes the steps of mixing separate aqueous solutions to produce a mixture. An aqueous first solution includes ammonium molybdate, and a dilute aqueous second solution includes potassium silicate and, optionally, an additional potassium source. The first solution has a pH and a specific gravity sufficient to promote formation of diammonium molybdate crystals in the mixture. The amounts of the potassium silicate and the additional potassium source in the dilute second solution and the amount of the dilute second solution are selected to provide a predetermined amount of potassium and a predetermined amount of silicon in the mixture. The mixture is heated to a temperature sufficient to aid dissolution of the potassium silicate, the additional potassium source, and the ammonium molybdate in the mixture and to produce a homogeneous third solution including ammonium molybdate, potassium, and silicon. The ammonium dimolybdate doped with potassium and silicon is crystallized out of the third solution, and calcined to produce molybdenum dioxide doped with potassium and silicon. The molybdenum dioxide is then reduced to produce molybdenum powder doped with potassium and silicon.

In a narrower aspect of the invention, the first solution has a pH of about 8.8–11.0 at about 20° C. and a specific gravity of about 1.20–1.32. In another narrower aspect, the amounts of the potassium silicate and the additional potassium source in the dilute second solution and the amount of the dilute second solution are selected to provide an amount of potassium in the mixture of about 800–1300 ppm and an amount of silicon in the mixture of about 500–1100 ppm, both amounts based on the amount of molybdenum in the mixture. In yet another narrower aspect, the doped molybdenum powder is pressed to form and ingot, and the ingot is sintered to a density of at least 91% of theoretical density.

DETAILED DESCRIPTION OF THE PREFERRED EMBODIMENTS

An exemplary process in accordance with the invention is described herein. The process adds the dopants, e.g., a potassium silicate solution to a hot aqueous ammonium molybdate solution. The ammonium molybdate is then crystallized to produce ammonium dimolybdate (ADM) crystals doped with potassium and silicon, which may be processed in a reducing atmosphere to produce the doped KS molybdenum alloy.

Another potassium compound, e.g., potassium hydroxide may be added to or, preferably, with the potassium silicate solution to bring the relative amounts of potassium and silicon to the desired level relative to the molybdenum content of the solution. Typical molar ratios are 800–1300 ppm potassium and 500–1100 ppm of silicon relative to the molybdenum in solution. The preferred ratios are about 1000 ppm potassium:molybdenum and about 700 ppm silicon:molybdenum in the ammonium molybdate solution.

The optimum amount of the molybdenum in the solution may be empirically determined, as long as the molybdenum concentration is sufficiently high to crystallize out on cooling of the solution. Preferably, the starting ammonium molybdate solution contains about 219–253 g/l of molybdenum, although lower or higher concentrations are suitable, up to a saturated solution (specific gravity about 1.310–1.320). The preferred ammonium molybdate solution has a pH of about 8.8–11.0, most preferably 9.0–9.6, at room temperature. Typically, the ammonium molybdate solution has a specific gravity of about 1.260 (at 219 g/l molybdenum) to about 1.300 (at 253 g/l molybdenum), although solutions having lower or higher specific gravities (e.g., 1.20–1.32) are possible for use as the starting solution. The molybdate solution is described as ammonium molybdate (AM) solution rather than ammonium dimolybdate (ADM) solution, because at the pH and specific gravities described above only the monomolybdate molecule is present in the solution. This molybdate (AM) molecule is converted to the dimolybdate (ADM) on heating when the pH of the first solution is that described above. If required, the pH may be adjusted by adding, e.g., ammonium hydroxide.

The potassium silicate may be obtained as a potassium silicate solution, e.g., Electronic Grade E200, available from Zaclon Inc. Electronic Grade E200 includes 19.5 weight % $Si_2O$ and 9.42 weight % $K_2O$, a weight ratio of $SiO_2$ to $K_2O$ of 2.07, a mole ratio of silicon to potassium of 3.25, a specific gravity at 60° C. of 30.45, 29.50% total solids, and a maximum of 0.004% iron. Preferably, the potassium silicate solution is diluted with water before it is added to the ammonium molybdate solution to prevent formation of a colloidal gel. The silicate solution preferably is diluted at a volume ratio of at least about 5:1 silicate solution to water, with the water at a temperature of at least about 20°–60° C. The most preferred dilution is about 9.0:1–9.6:1, although dilutions of up to about 14:1 are considered suitable. The diluted solution may then be stirred or mixed thoroughly.

If it is desired to alter the ratio of potassium to silicon in the silicate solution, another potassium compound may be added to the silicate solution or, preferably, to the ammonium molybdate/potassium silicate solution mixture. A typical additive for this purpose is potassium hydroxide.

The diluted potassium silicate solution is then added to the ammonium molybdate solution, and the solution is heated, preferably to boiling, to aid dissolution of the components in the mixed solution. Preferably, the molybdate solution is heated as the silicate solution is added, and heating continues until the solution is boiling.

The doped solution is cooled to crystallize the ammonium dimolybdate, then filtered and dried. The doped ammonium dimolybdate crystals are converted to doped molybdenum dioxide, which in turn is converted to the desired doped molybdenum alloy, KS molybdenum, by processes conventional in the production of pure molybdenum metal from pure ADM crystals. For example, the doped ADM crystals may be calcined in an atmosphere of dissociated ammonia or hydrogen to reduce the crystals to doped molybdenum dioxide. The doped molybdenum dioxide may then be converted to KS molybdenum by heating in a reducing atmosphere, preferably hydrogen. At this point in the process, the potassium:molybdenum and silicon:molybdenum ratios in the metal powder typically are about 150–300 ppm and 300–600 ppm, respectively.

Typically, the resulting KS molybdenum is cooled, sifted, and pressed into an ingot, then sintered to a high density, preferably greater than 9.28 g/cc which is 91% of the theoretical density of molybdenum. Typical potassium and silicon concentrations in the sintered alloy are about 100–200 ppm potassium:molybdenum and 200–500 ppm silicon:molybdenum. The preferred ratios are 150±10 ppm potassium:molybdenum and 400±50 ppm silicon:molybdenum.

In alternative processes, the doped molybdenum powder or its precursors may be produced with an excess of potassium and silicon, and mixed with the corresponding pure molybdenum powder or precursors at any suitable point in the process. For example, the doped molybdenum powder with an excess of potassium and silicon may be homogeneously mixed with pure molybdenum powder before being pressed into an ingot and sintered. Alternatively, the doped ammonium dimolybdate crystals may be homogeneously mixed with pure ammonium dimolybdate crystals before conversion of the crystals to molybdenum dioxide. The relative amounts of potassium, silicon, and molybdenum in the doped compounds or alloy in these processes may be empirically determined.

The following Example is presented to enable those skilled in the art to more clearly understand and practice the present invention. The Example should not be considered as a limitation upon the scope of the present invention, but merely as being illustrative and representative thereof.

EXAMPLE

A potassium silicate solution (Electronics Grade No. 200) was diluted at nine parts water to one part solution, and the mixture was stirred to ensure homogeneity. This diluted solution was stirred into an ammonium molybdate solution while the molybdate solution was being heated. Heating was continued to bring the mixture to a boil, and boiling of the solution continued until the components appeared to be completely dissolved in the solution. The solution was cooled to ambient temperature and filtered, crystallizing and separating out the potassium and silicon doped ammonium dimolybdate product, and the crystals were dried in a drying oven.

The doped ADM crystals were then converted to molybdenum dioxide in a rotary tube calciner at 1300° C. in an atmosphere of dissociated ammonia flowing at about 1500 cfh. The furnace tube was rotated at 5.0 rpm, and the screw feed was set at 1 to give an oxygen concentration in the molybdenum dioxide of about 25.0–26.0 weight %.

The molybdenum dioxide product of the calcining was reduced to molybdenum in a tube furnace at about 1050° C. in a hydrogen atmosphere flowing at about 400 cfh. Boat loads of 2500 g each were fed into the furnace at a stoke rate of 2 boats every 40 min, giving a dwell time in the furnace of about 6 hr. The KS molybdenum product from 200 boats of powder was sifted through a 100 mesh screen, blended together, and pressed into individual 4.5 kg ingots. The ingots were sintered to >9.28 g/cc density.

The resulting sintered KS molybdenum alloy included 150 ppm potassium and 300 ppm silicon. Wire drawn from the ingots, after reduction in cross section equivalent to a true strain of about 3, was ductile after recrystallization and had a morphology of elongated, interlocking grains.

The invention described herein presents to the art novel, improved process for manufacturing KS molybdenum which allows for production of the alloy at approximately the same cost and using the same equipment as that for the manufacture of pure molybdenum. Thus, any facility equipped to produce pure molybdenum from an ammonium molybdate solution may be readily adapted to produce KS molybdenum at little additional expense.

While there has been shown and described what are at present considered the preferred embodiments of the invention, it will be apparent to those skilled in the art that modifications and changes can be made therein without departing from the scope of the present invention as defined by the appended claims.

We claim:

1. A process for producing potassium and silicon doped molybdenum comprising the steps of:

mixing an aqueous first solution comprising ammonium molybdate and a dilute aqueous second solution comprising potassium silicate and, optionally, an additional potassium source to produce a mixture, wherein said first solution has a pH and a specific gravity sufficient to promote formation of diammonium molybdate crystals in said mixture, and wherein the amounts of said potassium silicate and said additional potassium source in said dilute second solution and the amount of said dilute second solution are selected to provide a predetermined amount of potassium and a predetermined amount of silicon in said mixture;

heating said mixture to a temperature sufficient to aid dissolution of said potassium silicate, said additional potassium source, and said ammonium molybdate in said mixture and to produce a homogeneous third solution comprising ammonium molybdate, potassium, and silicon;

crystallizing ammonium dimolybdate doped with potassium and silicon out of said third solution;

calcining said doped ammonium dimolybdate to produce molybdenum dioxide doped with potassium and silicon; and reducing said molybdenum dioxide to produce molybdenum powder doped with potassium and silicon.

2. A process in accordance with claim 1 wherein said pH of said first solution is about 8.8–11.0 at 20° C. and said specific gravity of said first solution is about 1.20–1.32.

3. A process in accordance with claim 1 wherein said predetermined amount of potassium is about 800–1300 ppm and said predetermined amount of silicon is about 500–1100 ppm, both predetermined amounts based on the amount of molybdenum in said mixture.

4. A process in accordance with claim 3 wherein said predetermined amounts of potassium and silicon in said dilute second solution are about 9–11 g/l and 10–13 g/l, respectively.

5. A process in accordance with claim 4 wherein said predetermined amounts of potassium and silicon in said dilute second solution are about 10.0 g/l and 11.9 g/l, respectively.

6. A process in accordance with claim 4 further comprising the step, before said mixing step, of preparing said dilute second solution by diluting a potassium silicate solution with water at a temperature of about 20°–60° C. at a volume ratio between about 1:5 and about 1:14, solution to water, to produce said dilute second solution.

7. A process in accordance with claim 1 wherein no additional potassium source is added to said second solution, and further comprising the step of separately adding said additional potassium source as a third aqueous solution to said mixture to adjust said amount of potassium in said mixture.

8. A process in accordance with claim 1 wherein said heating step comprises heating said mixture during said mixing step to a temperature of about 100° C.

9. A process in accordance with claim 1 wherein said calcining step is carried out in an atmosphere comprising dissociated ammonia.

10. A process in accordance with claim 1 wherein said reducing step is carried out in a flowing hydrogen atmosphere.

11. A process in accordance with claim 1 further comprising the steps of pressing a powder comprising said doped molybdenum powder to form an ingot; and sintering said ingot to a density of at least 9.28 g/cc.

12. A process in accordance with claim 3 further comprising the steps of pressing a powder comprising said doped molybdenum powder to form an ingot; and sintering said ingot to a density of at least 9.28 g/cc; and wherein said sintered ingot comprises about 100–200 ppm potassium and about 200–500 ppm silicon.

13. A process in accordance with claim 11 further comprising the steps, before the pressing step, of milling said doped molybdenum powder to break up large particles; and sifting said sifted doped molybdenum powder through a 100 mesh screen to remove any remaining large particles.

14. A process in accordance with claim 11 further comprising the step, after said sintering step, of working said sintered ingot at a true strain value greater than about 3 to increase the recrystallization temperature to greater than 1500° C. and to produce a crystal structure of elongated, interlocking grains and improved ductility.

15. A process for producing potassium and silicon doped molybdenum comprising the steps of:

diluting an aqueous solution containing about 19.5 weight % $SiO_2$ and about 9.42 weight % $K_2O$ with water at a dilution temperature of about 20°–60° C. at a volume ratio between about 1:5 and about 1:14, solution to water, to produce a dilute potassium silicate solution;

mixing an aqueous solution of ammonium molybdate and said dilute potassium silicate solution to produce a mixture, wherein said ammonium molybdate solution has a pH of about 8.8–11.0 at about 20° C. and a specific gravity of about 1.20–1.32, and wherein the amount of said dilute second solution is selected to provide an amount of potassium in said mixture of about 800–1300 ppm and an amount of silicon in said mixture of about 500–1100 ppm, both amounts based on the amount of molybdenum in said mixture;

heating said mixture during said mixing step to a mixing temperature of about 100° C. and maintaining said mixing temperature for a time sufficient to produce a homogeneous third solution comprising ammonium molybdate, potassium, and silicon;

crystallizing ammonium dimolybdate doped with potassium and silicon out of said third solution;

calcining said doped ammonium dimolybdate in an atmosphere comprising dissociated ammonia to produce molybdenum dioxide doped with potassium and silicon;

reducing said molybdenum dioxide by heating said molybdenum dioxide in an atmosphere of flowing hydrogen to produce molybdenum powder doped with potassium and silicon;

milling said doped molybdenum powder to break up large particles;

sifting said milled, doped molybdenum powder through a 100 mesh screen to remove any remaining large particles;

pressing said sifted, doped molybdenum powder to form an ingot;

sintering said ingot to a density of at least 9.28 g/cc; and working said sintered ingot at a true strain value greater than about 3 to increase the recrystallization temperature to greater than 1500° C. and to produce a crystal structure of elongated, interlocking grains and improved ductility.

* * * * *